United States Patent [19]

Outten et al.

[11] 4,116,877

[45] Sep. 26, 1978

[54] ELASTOMER COMPATIBLE SEAL SWELL ADDITIVE FOR AUTOMATIC TRANSMISSION FLUIDS, POWER TRANSMISSION FLUIDS AND HYDRAULIC STEERING APPLICATIONS

[75] Inventors: Edward Francis Outten; Jack Ryer, both of East Brunswick; John E. Williams, Cranford, all of N.J.

[73] Assignee: Exxon Research & Engineering Co., Linden, N.J.

[21] Appl. No.: 813,893

[22] Filed: Jul. 8, 1977

[51] Int. Cl.[2] .....C10M 1/46; C10M 1/20

[52] U.S. Cl. ..... 252/72; 252/49.8; 252/78.5

[58] Field of Search .....252/78.5; 252/72, 49.8

[56] References Cited

U.S. PATENT DOCUMENTS

| | | | |
|---|---|---|---|
| 3,115,463 | 12/1963 | Orloff et al. | 252/49.8 |
| 3,115,464 | 12/1963 | Orloff et al. | 252/49.8 |
| 3,115,465 | 12/1963 | Orloff et al. | 252/49.9 |
| 3,556,999 | 1/1971 | Messina et al. | 252/78.5 |

FOREIGN PATENT DOCUMENTS

| | | |
|---|---|---|
| 50-4,016 | 2/1975 | Japan. |
| 1,282,652 | 7/1972 | United Kingdom. |

*Primary Examiner*—Harris A. Pitlick

*Attorney, Agent, or Firm*—Roland A. Dexter; Frank T. Johmann

[57] ABSTRACT

A fluid having a mineral lubricating oil base and containing the combination of an oil-soluble tris ($C_8$–$C_{24}$ hydrocarbyl) phosphite ester and an oil-soluble $C_8$–$C_{24}$ hydrocarbyl substituted phenol, the weight ratio of said phosphite to said phenol ranging from about 4:1 to 1:4, preferably 3:1 to 1:3 whereby elastomer compatibility of said fluid is enhanced. The phosphite ester-substituted phenol combination imparts to the fluid the property of maintaining the chemical and physical properties of seals under oxidizing condition in automatic transmissions, power transmissions and power steering systems and thereby improves retention of the fluid in these mechanical structures; preferably when at least an inhibitory amount of an anti-oxidant capable of trapping free radicals at temperatures above 65° C., preferably 80 ° to 200° C. is present.

9 Claims, No Drawings

ELASTOMER COMPATIBLE SEAL SWELL ADDITIVE FOR AUTOMATIC TRANSMISSION FLUIDS, POWER TRANSMISSION FLUIDS AND HYDRAULIC STEERING APPLICATIONS

BACKGROUND OF THE INVENTION

The present invention relates to an improved lubricating fluid and particularly concerns an additive for such a fluid that will improve its seal swelling property concurrent with seal compatibility without at the same time imparting any detrimental effects thereto. The invention is also directed to additive concentrate packages that are intended for formulation into mineral oil base stocks to provide power transmission fluids of improved seal compatibility characteristics thereby enhancing fluid retention. These fluids have particular utility in a hydraulic fluid power steering mechanism.

A very high percentage of vehicles such as automobiles, tractors and earthmovers are now equipped with some type of semi-automatic or fully automatic transmission and/or power steering systems. These transmissions and systems must be proved with a supply of fluid that serves the multiple functions of a power transmitting medium, a hydraulic control fluid, a heat transfer medium, and a satisfactory lubricant. This fluid to be useful must be capable of operating over a wide temperature range, possess a high degree of oxidation resistance, be free of corrosive action, have foam control, have satisfactory low temperature fluidity, retain a useful viscosity at high temperatures, have transmission seal compatibility and lubricity without "stick-slip" of the transmission parts.

Power transmission fluids are probably one of the most complex automotive products offered by the lubricant supplier since the base oil contains one or more of the additive types: oxidation inhibitors; dispersants; metal deactivators; viscosity index improver; anti-wear agents; rust inhibitors; corrosion inhibitors; foam inhibitors; seal swellers; and friction modifiers (see *Lubrication,* Vol. 54, Nov. 1, 1968, pages 1–16). The seal swell agents must not only swell the seals sufficiently to contain the fluid within the transmission housing but must be compatible (as must the formulated transmission fluid) with the sealing materials which are generally nitrile, polyacrylate and isoprene elastomers. This compatibility is evidenced by retention of tensile strength and elongation without cracking after extended exposure to said fluids. The compatibility is even more critical in power steering applications where internal pressures of from 500 to 1000 psi are imposed on the seals (2500 to 5000% greater than forces found in automatic transmissions).

Since the current approach to improving transmission fluids is to adjust and modify the various additives so as to extend their useful lifetime, this approach is of little value unless the fluid is retained within the transmission system. Many of the automatic transmissions in use in vehicles at the present time lose significant quantities of transmission fluid, principally because of deterioration of the rubber-type seals or gaskets. As a result of this there have been numerous attempts to develop oil-soluble additives that can be formulated with or added to transmission, power steering and other hydraulic fluids to facilitate retention by suitably swelling and softening the rubber of elastomers in those seals and gaskets. The seal swell-soften additive should not lower the viscosity of the transmission fluid nor degrade its compatability with the sealing material. However, the essential need is to improve the transmission fluid, particularly that fluid originally placed in transmission, so that it is more completely and longer retained.

U.S. Pat. No. 3,389,088 teaches one class, i.e., aliphatic alcohols of 8 to 13 carbon atoms, e.g., tridecyl alcohol, of additives which perform to suitably swell the various gaskets and seals of automatic transmission systems. This type of additive has been improved on by its use in combination with an oil-soluble, saturated hydrocarbyl ester of 10 to 60 carbon atoms and 2 to 3 ester linkages, e.g., dihexyl phthalate (see U.S. Pat. No. 3,974,081).

Although not directed to "seal swelling" or "compatibility" requirements of hydraulic fluid compositions, several patents teach the combination of a phosphite and substituted phenol in fluid compositions having superior stability to oxidation:

U.S. Pat. No. 3,556,999 shows a major amount of lubricating oil containing a minor amount of each of $C_1$–$C_8$ alkyl substituted phosphites, $C_1$ to $C_4$ alkyl substituted phenols or aromatic secondary amine and a dispersant copolymer containing N-vinyl-2-pyrrolidone; U.K. Pat. No. 1,282,652 teaches of a pump fluid containing from 0.2 to 2.0% of its weight of an organic antioxidant of the class consisting of phenols (preferably sterically hindered bisphenols), tris nonylphenyl phosphite and mixtures thereof; U.S. Pat. No. 3,115,465 teaches of a mixture of organic phosphite ester and methylenedbisphenol as an oxidation inhibitor for lubricating oils and for elastomers, including nitrile rubbers; and, Japan No. 75–4016 teaches the combination of a 2,2'thiobisphenol and tris(nonylphenyl) phosphite as an antioxidant for hot asphalt in storage.

SUMMARY OF THE INVENTION

In accordance with the present invention, it has been discovered that mineral oil containing at least a seal swelling amount of the combination of an organophosphite having the general formula $(RO)_3P$ wherein R is a hydrocarbyl group containing from 8 to 24 carbons, preferably tris(nonylphenyl)phosphite and a phenol of the general formula

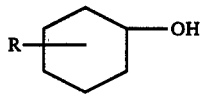

wherein R is a hydrocarbyl group of from 8 to 24 carbons, preferably nonylphenol; said organophosphite having a weight ratio to said phenol from 4:1 to 1:4, preferably 3:1 to 1:3 optimally about 3:2, surprisingly enhances the elastomer compatibility of said oil, as well as providing the essential components from which a hydraulic fluid of enhanced elastomer compatibility can be formulated.

The transmission fluid composition of the invention consists essentially of a major amount of mineral oil and a minor but at least a seal swelling amount of the combination of an organophosphite having the general formula $(RO)_3P$ wherein R is a hydrocarbyl group containing from 14 to 30 carbons, preferably tris(nonylphenyl)-phosphite, a phenol of the general formula

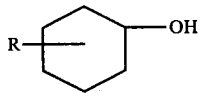

wherein R is a hydrocarbyl group of from 8 to 24 carbons, preferably nonylphenol, said organophosphite having a weight ratio to said phenol from 4:1 to 1:4, preferably 3:1 to 1:3, optimally about 3:2; and, an antioxidant having activity above 65° C., e.g., 80° C. to 200° C. plus additives such as a detergent, friction modifier, dispersant, pour point depressant, antiwear agent and antifoaming agent. The seal swelling amount usefully ranges from about 0.2 to 2.0, preferably 0.3 to 1.0, optimally about 0.5, wt.% based on the total weight of the hydraulic fluid.

Modification of the hydraulic fluid can be accomplished in several modes of operation including direct addition of said organophosphite-substituted phenol combination to the hydraulic fluid; admixture of said combination into an additive package wherein the mineral oil constitutes from about 10 volume percent to about 70 volume percent of the additive package; and by modification of the hydraulic fluid wherein mineral oil conventionally constitutes from about 70 volume percent to about 95 volume percent of said hydraulic fluid.

DESCRIPTION OF THE PREFERRED EMBODIMENTS OF THE INVENTION

As discussed earlier, hydraulic systems such as automatic transmission fluids (hereinafter designated ATF) and power steering fluids (hereinafter designated PSPF) are compounded from a number of additives each useful for improving a chemical and/or physical property of the ATF or PSPF. The additives are usually sold as a package in which mineral oil is present. The mineral lubricating oil will constitute from 10 to 70 volume percent of the package and is a refined hydrocarbon oil or a mixture of refined hydrocarbon oils selected according to the viscosity requirements of the particular fluid but typically would have a viscosity range of 75–200 SSU at 38° C. Typical additives for packages include viscosity index improvers, corrosion inhibitors, oxidation inhibitors, friction modifiers, dispersants, de-emulsifiers, anti-foaming agents, antiwear agents, pour point depressants and seal swellants.

The viscosity index improvers that may be employed in the hydraulic fluids of this invention include any of the types known to the art including polyisobutylene, copolymers of ethylene and propylene, polymethacrylates, methacrylate copolymers, copolymers of an unsaturated dicarboxylic acid and a vinyl compound and interpolymers of styrene and acrylic esters.

Corrosion and/or oxidation inhibitors defined hereafter as ashless anti-oxidizing agents are those which have activity (can trap generated free radicals) above 65° C., preferably 80° to 200° C. For optimum performance use those of the class consisting of: alkylated-diphenylamines wherein the alkyl groups each have at least 8, preferably 8 to 20, carbons; $C_8$–$C_{20}$ alkylated phenolic disulfides, e.g., nonyl-phenyl disulfide; and, polyaryl substituted amines. Reaction of a phospho-sulfurized hydrocarbon with an alkylene polyamine provides useful antioxidants. Phosphosulfurized hydrocarbons are prepared by reacting a suitable hydrocarbon such as a terpene, a heavy petroleum fraction or a $C_2$ to $C_6$ olefin polymer such as polyisobutylene with from 5 to 30 weight percent of a sulfide of phosphorus for 0.5 to 15 hours, at a temperature in the range of 65° to 315° C. Useful ashless anti-oxidizing agents include dioctyldiphenyl amine, phenyl-alpha-naphthylamine and mixtures of the foregoing. Antioxidants are preferably used in amounts ranging from about 0.25 to 1.0, preferably 0.5 to 0.8 wt.% based on the total weight of the fluid.

Friction modifiers adjust the frictional property of fluids to optimize the actual performance of the PS/AT systems without adversely affecting fluid performance and include organic fatty acid amides and quaternary ammonium salts of unsaturated fatty acids, e.g., disoya dimethyl-ammonium chloride and organic phosphorous esters.

Dispersants maintain oil insolubles resulting from oxidation during use in suspension in hydraulic fluids thus preventing sludge flocculation and precipitation. Suitable dispersants include high molecular weight alkyl succinates, the reaction product of polyisobutylene-succinic anhydride with tetraethylene penta-amine and borated salts thereof and alkyl thiophosphonates.

Pour point depressants lower the temperature at which the hydraulic fluid will flow or can be poured. Such depressants are well known. Typical of those additives which usefully optimize the low temperature fluidity of the hydraulic fluid of the invention are $C_8$–$C_{18}$ dialkyl fumarate vinyl acetate copolymers, polymethacrylates, and wax naphthalene condensation products.

A de-emulsifier suitable for the teachings of this disclosure is a commercially available blend of oxyalkylated materials sold as Breaxit 7937 by Exxon Chemical Company, U.S.A., Houston, Tex.

Foam control is provided by an anti-foamant of the polysiloxane type, e.g., silicone oil and polydimethyl siloxane.

Antiwear agents as their name implies reduce wear of the transmission parts. Representative of suitable antiwear agents are zinc dialkyl dithiophosphate, zinc diaryl dithiophosphate, magnesium sulfonate and organic phosphates.

Rust inhibitors include metal dithiophosphates, fatty acids and amines whereby potential corrosion brought about by action of moist air on the interior surfaces of ferrous parts of the hydraulic fluid housing is inhibited.

Some of these numerous additives can provide a multiplicity of affects, e.g., a dispersant-oxidation inhibitor. This approach is well known and need not be further elaborated herein.

The organophosphite of the seal compatibility combination of the invention has been characterized as broadly having the general formula

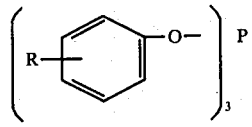

where R is a hydrocarbyl group having from 8 to 24 carbons, O represents oxygen and P represents phosphorous, R (each of which may be the same or different) includes octyl, nonyl (preferred), decyl, undecyl, dodecyl, etc., up to and including the $C_{24}$ alkyl group, tetracosyl as well as alkylaryls including ethylphenyl, nonylphenyl, etc., up to and including the $C_{24}$ alkylaryl group octadecylphenyl. The preferred embodiment is tris(nonylphenyl) phosphite wherein R is the same. Within the definition of R, it is to be understood that it may contain one or more inert constituents, such as chlorine, bromine, hydroxy, sulfur and the like.

The second component of the combination, i.e., the phenol, may be represented by the formula as earlier shown:

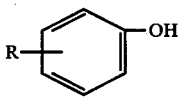

where R is a hydrocarbyl group of 8 to 24 carbons wherein R has the same meaning as for the organophosphite. The preferred embodiment of this second component is nonylphenol.

The two components of the combination described hereinbefore are employed in defined amounts when used in hydraulic fluids. The phosphite component is employed in the range of about 0.04 to 1.6%, by weight based on the fluid in which it is incorporated, optimally about 0.1 to 1.0% by weight. The oil-soluble substituted phenol is employed in the range of about 0.04 to 1.6% by weight with respect to the fluid in which it is to be used, optimally about 0.1 to 1.0% by weight.

It is important for the purposes of the present invention that one adhere strictly to the definitions of the two components given above; otherwise, valuable aspects of the present invention are not realized. One must adhere both to the specific structures defined and the ratios and the percentages of each employed in the compositions of this invention. By strict adherence to the composition of this invention, one obtains a hydraulic fluid, particularly a power steering fluid, that is expectedly superior in seal compatibility toward conventional elastomer seals, particularly nitrile rubbers.

Typically ATF and PSPF seals have been made: of a copolymer of butadiene and acrylonitrile known as Buna-N; polyacrylate; neoprene rubber, styrene-butadiene rubber; and, polyacrylonitrile. All are remarkably compatible with the seal swelling combination of this invention.

While generally standard blending techniques are employed, one preferably preblends all of the above-described components before they are incorporated into the hydraulic fluid base.

Furthermore, if one employs the fluid base oil alone or with any one of the components separately, seal swell and/or compatibility is inferior and unsatisfactory. Furthermore, any combination of two, outside of the weight ratio ranges of the two above-described components also gives inferior results. Base oils used herein for the hydraulic and automatic transmission fluids include a wide variety of light hydrocarbon oils, such as naphthenic base, paraffin base and mixtures of naphthenic and paraffin base mineral oils having a viscosity range of 14 to 43 cSt at 38° C.

The base oils are preferably a combination of paraffinic and naphthenic base stock wherein the blend usefully contains 10 to 40 weight percent of naphthenic oil.

Particularly preferred is a blend of 80 weight percent paraffinic oil having a viscosity of 30 cSt at 38° C. and 20 weight percent naphthenic oil having a viscosity of 14 cSt at 38° C.

When packages containing said seal swell-compatibility combination are employed for distribution to formulators of hydraulic fluids, said packages will contain based on the total weight:

| | |
|---|---|
| diluent base oil | 30–60 wt.% |
| seal swell-compatibility combination | 5–20 wt.% |
| ashless antioxidant | 10–20 wt.% |
| friction modifier | 1–5 wt.% |
| V.I. improver (if required) | 15–40 wt.% |
| as for example: | |
| oil | 40 wt.% |
| seal swell-compatibility combination | 12 wt.% |
| ashless antioxidant | 16 wt.% |
| friction modifier | 2 wt.% |
| and, V.I. improver | 30 wt.% |

PSPF lubricants contain many additives which are typically blended for use at the following range of treating levels.

| Components | Concn. Range Volume % |
|---|---|
| Viscosity Index Improver | 1–15 |
| Ashless Antioxidant | 0.01–1 |
| Friction Modifier | 0.01–1 |
| Dispersant | 0.2–2 |
| Pour Point Depressant | 0.01–1 |
| Anti-foaming Agent | 0.001–0.1 |
| Anti-wear Agent | 0.001–1 |
| Seal Swellent (100% active) | 0.1–5 |

The nature of this invention may be better understood when reference is made to the following examples.

EXAMPLE 1

Elastomer compatibility of a nitrile seal with the combination of the invention is shown by the results of a test wherein various combinations of the invention are admixed into a power steering fluid and the elastomer seal immersed in the test fluid for 70 hours at 149° C. The results are shown hereafter in Table I.

TABLE I

| Example | Total Wt.% of Combination | Tris-(nonylphenyl) Phosphite | Nonyl Phenol | Tensile Strength (psi) |
|---|---|---|---|---|
| 1 | 0.0 | 0.0 | 0.0 | 527 |
| 2 | 0.5 | 0.5 | 0.0 | 518 |
| 3 | " | 0.0 | 0.5 | 425 |
| 4 | " | 0.2 | 0.3 | 1156 |
| 5 | " | 0.3 | 0.2 | 1208 |
| 6 | 1.0 | 1.0 | 0.0 | 668 |
| 7 | " | 0.0 | 1.0 | 1069 |
| 8 | " | 0.7 | 0.3 | 1746 |
| 9 | " | 0.3 | 0.7 | 1865 |

A. The test fluids were prepared by mixing the elastomer compatibility agent to be tested in a PSPF blend of Solvent Neutral 150 mineral oil and a naphthenic solvent oil which contained about 0.7 wt.% of a mixture of commercial ashless dispersant/antioxidant and a commercial ashless antioxidant, 1.35 wt.% of a commercial multifunctionalized V.I. improver and 0.1 wt.% of a commercial friction modifier.

B. Tensile strength measured according to ASTM D1414–72 after fluid aging for 70 hours at 149° C. according to ASTM D471–72.

The marked improvements in elastomer compatibility provided according to this invention are clearly shown by comparing Examples 1–3 with Examples 4 and 5 and Examples 1 and 6–7 with Examples 8 and 9.

EXAMPLE 2

The PSPF blend as detailed in Table I[A] of Example 1 was admixed with tris(nonylphenyl)phosphite and a commercially available hindered phenol to evaluate their elastomeric compatibility properties. The results with a nitrile rubber showed a blend of phosphite and phenol such as is taught in U.K. Pat. No. 1,282,652 to be inferior in elastomer compatibility to the inventive combination as seen in Table II wherein Elongation to Break measurements were carried out according to ASTM D1414–72 after fluid aging as above per ASTM D471–72.

TABLE II

| Concentration of Phosphite-Phenol Agents in PSTF (Volume %)[A] | | | | |
|---|---|---|---|---|
| Total | Tris-(nonylphenyl) Phosphite | Hindered Phenol | Tensile[B] Strength(psi) | Elongation[C] To Break (%) |
| 1.0 | 0.5 | 0.5[702] | 420 | 27 |
| 1.0 | 0.5 | 0.5[728] | 480 | 23 |

[A]PSPF of Table I[A]

[B C]Tensile strength and Elongation to Break measured as in Table I.

[702]An alkylated (t-butyl) methylene bridged bisphenol sold as Ethyl Anti-oxidant 702 by Ethyl Corporation of Baton Rouge, LA.

[728]An impure alkylated t-butyl methylene bridged bisphenol sold as Ethyl Anti-oxidant 728 by Ethyl Corporation of Baton Rouge, LA.

EXAMPLE 3

The elastomer compatibility of a number of test transmission fluids derived from the modification of the PSPF blend of Table I[A] with from 0.1 to 1 wt.% of another chemical were evaluated by reference to the tests of tensile strength and elongation to break on elastomer seals and O rings. All the following were found inferior to the compatibility blend of the invention: tricresyl phosphite; polyisobutenyl succinic anhydride alkylene polyamine dispersant; benzyl disulfide; dilauryl sulfide; and, overbased magnesium sulfonate.

The invention in its broader aspect is not limited to the specific details shown and described and departures may be made from such details without departing from the principles of the invention and without sacrificing its chief advantages.

What is claimed is:

1. In a method of operating a hydraulic transmission having elastomer seals subject to deterioration and leakage, the improvement of using a transmission fluid comprising mineral oil containing at least a seal swelling amount of the combination of an organophosphite having the general formula $(RO)_3P$ wherein R is a hydrocarbyl group containing from 8 to 24 carbons and a phenol of the general formula

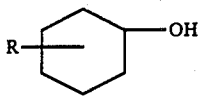

wherein R is a hydrocarbyl group of from 8 to 24 carbons; said organophosphite having a weight ratio to said phenol from 4:1 to 1:4, whereby the compatibility of said oil for said elastomer is enhanced.

2. In a method according to claim 1 wherein said organophosphite is tris(nonylphenyl)phosphite and said phenol is nonylphenol.

3. In a method according to claim 2 wherein said organophosphite has a weight ratio to said phenol from 3:1 to 1:3.

4. In a method according to claim 2 wherein said mineral oil contains at least an antioxidizing amount of an ashless antioxidant having activity above 65° C.

5. In a method according to claim 4 wherein said antioxidizing amount ranges from about 0.25 to 1.0 wt.% based on the total weight of said fluid.

6. A hydraulic fluid consisting essentially of a major amount of mineral oil and a minor but at least a seal swelling amount of the combination of an organophosphite having the general formula $(RO)_3P$ wherein R is a hydrocarbyl group containing from 14 to 30 carbons and a phenol of the general formula

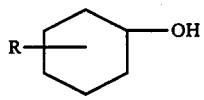

wherein R is a hydrocarbyl group of from 8 to 24 carbons, said organophosphite having a weight ratio to said phenol from 4:1 to 1:4.

7. The hydraulic fluid according to claim 6 wherein said organophosphite is tris(nonylphenyl)phosphite, said phenol is nonylphenol and said ratio is 3:1 to 1:3.

8. The hydraulic fluid according to claim 7 wherein said amount ranges from about 0.2 to 2.0 weight percent and said fluid contains from about 0.25 to 1.0 weight percent of an ashless antioxidant having activity from about 80° C. to 200° C.

9. An additive package for hydraulic systems comprising the combination of from about 30 to 60 wt.% of a mineral oil, from about 1 to 5 wt.% of a friction modifier, from about 10 to 20 wt.% of an ashless antioxidant and from about 5 to 20 wt.% of a seal swell-compatibility combination of an organophosphite having the general formula $(RO)_3P$ wherein R is a hydrocarbyl group containing from 14 to 30 carbons and a phenol of the general formula

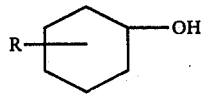

wherein R is a hydrocarbyl group of from 8 to 24 carbons, said organophosphite having a weight ratio to said phenol from 4:1 to 1:4.

* * * * *